United States Patent [19]

Pettersson

[11] Patent Number: 4,563,143

[45] Date of Patent: Jan. 7, 1986

[54] ISOSTATIC PRESS

[75] Inventor: Ola Pettersson, Höganäs, Sweden

[73] Assignee: KB Cold Isostatic Press Systems CIPS, Höganäs, Sweden

[21] Appl. No.: 591,340

[22] Filed: Mar. 20, 1984

[30] Foreign Application Priority Data

Apr. 19, 1983 [SE] Sweden ..... 8302201

[51] Int. Cl.[4] ..... B28B 3/00

[52] U.S. Cl. ..... 425/151; 100/219; 425/405 H; 425/413; 425/451.5

[58] Field of Search ..... 425/151, 154, 405 H, 425/406, 413, 414, 416, 451, 451.5, 451.6, 451.7, 451.9, 595, DIG. 220–DIG. 222; 100/219

[56] References Cited

U.S. PATENT DOCUMENTS

| | | | |
|---|---|---|---|
| 2,335,807 | 11/1943 | Smith | 425/DIG. 220 |
| 2,395,316 | 2/1946 | Brunner | 425/595 |
| 2,475,394 | 7/1949 | Lester | 425/DIG. 220 |
| 2,585,297 | 2/1952 | Beuscher | 425/DIG. 222 |
| 3,208,373 | 9/1965 | Bachelier | 425/DIG. 220 |
| 3,262,158 | 7/1966 | Von Reimer et al. | 425/595 |
| 3,579,741 | 5/1971 | Schwartz | 425/151 |
| 3,698,843 | 10/1972 | Bowles et al. | 425/86 |
| 4,088,432 | 5/1978 | Farrell | 425/150 |
| 4,243,369 | 1/1981 | James | 425/451.9 |

*Primary Examiner*—Jay H. Woo
*Assistant Examiner*—J. Fortenberry
*Attorney, Agent, or Firm*—Burns, Doane, Swecker & Mathis

[57] ABSTRACT

An isostatic press includes a closed press frame, there being a pressure chamber bearing against a first interior portion of the frame. A conveyor path for pressure chamber closures (3) each carrying a press tool part, extends through the frame under the pressure chamber, displacement means being arranged for lifting in the plane of the frame a chamber closure (3) into contact with the pressure chamber. During pressurization of the pressure chamber (1) the closure (3) is carried by two separate support legs (4,5) pivotably mounted in the plane of the frame, the conveyor path extending between the legs. The closure (3) is carried in the plane of the frame by a portion (72) of the conveyor path, which constitutes the lower press table of the press and is supported by the legs. The free end surfaces of the legs may have an arcuate contour in the plane of the frame and coact with complementally formed surfaces on the underside of said portion (72). The center of curvature for the circular end surface is preferably displaced inwardly towards the interior of the frame from the mean force line (A) of the respective leg.

20 Claims, 4 Drawing Figures

ISOSTATIC PRESS

TECHNICAL FIELD

The invention relates to an isostatic press including a press frame, a pressure chamber arranged in the frame and bearing against a first portion thereof, a pressure chamber closure carrying a press tool part and arranged displaceable along a path through the frame between the pressure chamber and a second portion of the frame situated directly opposite the first frame portion, an apparatus for displacing the chamber closure between the portion of the path lying in the frame and the pressure chamber, and an apparatus for carrying the chamber closure in connection with the pressure chamber during pressurizing thereof.

BACKGROUND OF THE INVENTION

Isostatic presses must withstand very high pressure, and very large forces arise with increasing press tool sizes. It has been found suitable to take up the arising forces in a frame, which axially directly supports the cylindrical pressure chamber and the pressure chamber closure (arranged movable toward and from the pressure chamber for allowing the insertion of a press tool carried by the closure) in a closed position indirectly bearing against the portion of the frame situated opposite the pressure chamber. It is conventional to dimension a hydraulic cylinder, adapted for displacing the closure to and from its working position, so that the hydraulic cylinder withstands the axial forces occurring when the press is pressurized. With the high axial press forces which have lately become applicable, e.g. 6000 tons, it has however been found practically unreasonable to dimension the hydraulic cylinder for withstanding such large loads and for being able to carry out its working stroke in a time suitable for its purpose.

It is further known to introduce a filler body between the closure when the latter joins up with the pressure chamber and the opposing part of the frame for locking the closure in its working position. See U.S. Pat. No. 3,867,077, for example. It is further known from U.S. Pat. Nos. 3,698,843 and 3,677,674 to arrange a locking block for the closure instead of such a filler body, this locking block being mounted on the side members of the frame. In comparison with the filler body, such locks have a considerably lower mass and therefore lower inertia forces occur during driving of the locks to and from the working position, although the blocks exercise an unfavourable force effect on the frame legs. In accordance with the accounted known art, there is further required a comparatively large space for the members which are to block the enclosure in a working position, and further space is required around the press itself to allow the locking members to be completely moved away so that the press tool and pressure chamber closure can pass through the frame in a line operation, which is required for economic reasons in the optimum utilization of the expensive isostatic press.

One object of the invention is therefore to provide a new isostatic press with the aid of which the mentioned drawbacks are circumvented or reduced in connection with retaining the closure while the press is pressurized, guidance of press tools through the press frame and the stresses on the press frame.

SUMMARY OF THE INVENTION

The inventive isostatic press is based on a press structure including a press frame, a pressure chamber arranged in the frame and bearing against a first portion of the frame, a pressure chamber closure carrying a press tool part and displaceable along a path through the frame between the pressure chamber and a second portion of the frame situated directly opposite the first frame portion, a means for displacing the chamber closure between the portion of the path situated in the frame and the pressure chamber, and a means for carrying the pressure chamber closure when the register with the pressure chamber during pressurization thereof. Against this background the inventive improvement of the press is distinguished in that the support means includes two separate support legs pivotably mounted in the plane of the frame on the second frame portion, the path extending between the legs and the free end surface of each leg in the plane having a preferably arcuate contour, and in the supporting position of the support leg connecting up to the correspondingly formed abutting surfaces on the underside of a portion of the displacing means carrying the chamber closure. The inventive support legs can, with relatively small inertia forces and thereby rapidly, be swung to and from their two end positions under the action of small guiding forces. Furthermore, the support legs bear against the end portions of the second frame portion, i.e. the lower yoke of the frame, so that deflection of the yoke is reduced, which means that the axial length alteration of the frame under the action of the pressure in the press is reduced.

In a particularly preferred embodiment of the invention, the normal direction for the free end surface of each leg may be arranged to deviate by a small angle from the direction of the mean line of force in the leg so that the press forces urge the legs towards each other. In this way the support leg structure will have a self-locking function.

If the free end of each leg has a circular end surface in the above-mentioned embodiment, the centre of curvature of this circular end surface will be displaced inwards towards the interior of the frame from the mean force line of the leg.

The support legs can furthermore have mutually opposing and complementary abutments on their free ends on the mutually opposing sides thereof, the abutments being intended to come into mutual contact in the load-bearing position of the support legs. The abutments will then take up the forces pressing the legs towards each other. In such an arrangement, detection means can be carried by the legs and preferably in association with the abutments, the detection means being adapted for indicating that the free ends of the legs have assumed a correct mutual position for carrying the closure when in register with the pressure chamber, and can be adapted such as to prevent pressurizing the pressure chamber in the absence of such indication. Other detection means sensing the load can be mounted on the support legs. Should there be overloading the pressurization of the pressure chamber is broken off.

Means, e.g. in the form of hydraulic cylinders, can be arranged to swing the legs between one position in which the closure can pass between the legs, and a second position in which they carry the closure when in place on the pressure chamber. As mentioned, the pivoting means may consist of hydraulic cylinders pivotably connected to the respective tension bar of the press frame and to the upper portion of each support leg.

The invention will now be described in detail in the form of an example with reference to the appended drawings.

DETAILED DESCRIPTION OF THE PREFERRED EMBODIMENT

Figure 1:
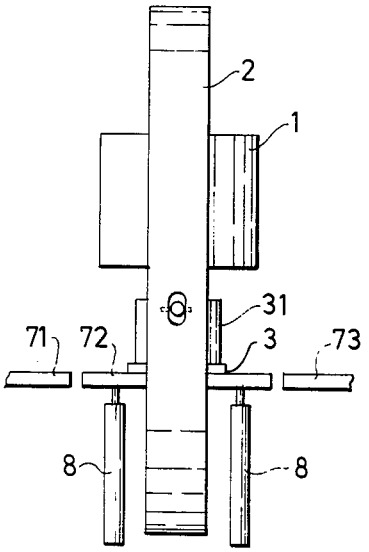
FIG. 1 is a schematic side view of an isostatic press.
Figure 2:
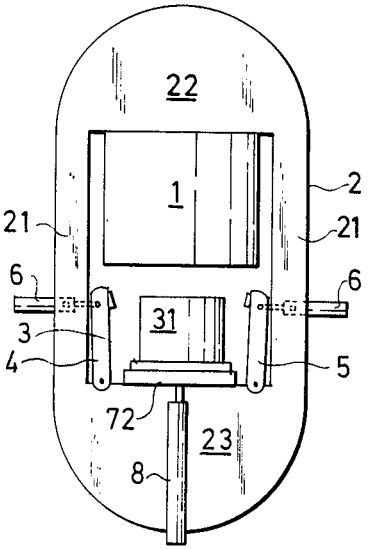
FIG. 2 is a front view of the press according to FIG. 1.

An isostatic press is illustrated in the FIGS. 1 and 2 and contains a pressure chamber 1 surrounded by a press frame 2. The pressure chamber 1 is supported by an upper yoke 22 of the frame. A conveyor 71,72,73 for a press tool 3,31 extends through the frame 2. A portion 72 of the conveyor 71–73 constitutes the lower press table and can lift the press tool 3,31 with the aid of hydraulic cylinders 8 so that the tool is inserted into and closes off the pressure chamber 1. The tool 3,31 may be regarded as comprising a magazine consisting of a die 31 and a closure 3 for the opening of the pressure chamber 1.

As schematically illustrated in FIG. 2, two support legs 4,5 are pivotably mounted on a lower yoke 23 of the frame 2 adjacent the frame tension bars 21 connected by the yoke 23, so that an open space can be made free for the passage of the tool 3,31 on the conveyor 72 through the opening of the frame 2 between the support legs 4,5. The legs 4,5 are retractable about their bearings on the lower yoke 23 in the plane of the frame 2 with the aid of hydraulic cylinders 6 which are pivotably mounted on the frame tension bars 21 and are connected to the support legs 4,5.

Figure 3:
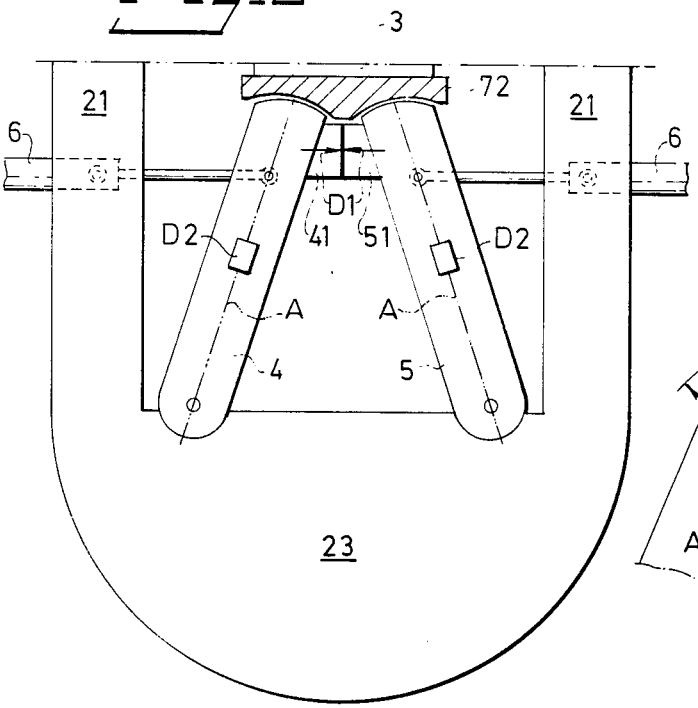
FIG. 3 illustrates to a larger scale the lower portion of the press according to FIG. 2.

As will be more clearly seen from FIG. 3, the free ends of the legs 4,5 may be formed with a circular contour in the plane of the frame 2, the surface of the free end of each leg 4,5 mating with complementarily formed surfaces on the underside of the lower press table 72 when the legs 4,5 are in a locked position.

At their upper ends the legs 4,5 have support abutments 41,51 through which the legs bear against each other in the operative position of the press. Detectors D1 may be arranged in association with the abutments 41,51 such that when the abutments are in a mutually correct position (when the legs 4,5 have assumed the correct position relative the press table 72) a signal departs from the detectors D1 allowing pressurization of the pressure chamber 1.

Detectors D2 may be arranged at the middle of the support legs. If the support legs are overloaded a signal is emitted from the detectors D2 for breaking off pressurization of the pressure chamber.

The lower ends of the support legs 4,5 may have the illustrated configuration and be mounted in unillustrated spherical bearings, which are either imbedded to the lower yoke 23 or mounted above it in the vicinity of the tension bars 21 at equal spacing from the plane of symmetry of the lower yoke 23.

Figure 4:
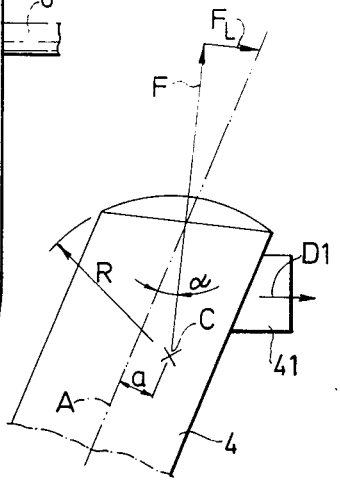
FIG. 4 illustrates the free end of a support leg in the press.

As is more clearly apparent from FIG. 4, the free end of each leg 4 may have a circular contour with a radius R, the centre of curvature C of the contour being displaced a distance a from the mean force line A of the leg.

The reaction force F of the leg towards the lower press table 72 will thus extend with an angle ($\alpha$) to the mean force line A such that a locking force $F_L$ arises, which urges the legs towards each other under the action of the press force.

I claim:

1. An isostatic press including a press frame having two frame legs, said press frame comprising opposed first and second yokes which are interconnected by said frame legs, a pressure chamber positioned within the frame and bearing against said first yoke of the frame, a pressure chamber closure which carries a press tool and is displaceable along a path through the frame substantially perpendicularly to a plane of the frame between the pressure chamber and said second yoke of the frame, means for reciprocally moving said chamber closure between said path and said pressure chamber, and means for supporting the chamber closure during pressurization of the pressure chamber wherein said means for supporting the chamber closure includes two support legs pivotally mounted in said plane of the frame on opposite sides of said path, a lower end of each support leg being mounted on the second frame yoke portion and an upper end of each support leg being provided with an arcuately contoured surface for mating with a corresponding surface of the chamber closure formed along a side of the chamber closure opposite the pressure chamber.

2. The isostatic press of claim 1, wherein an upper end surface of each support leg deviating from a mean force line of the support leg such that press forces which develop during operation of the press urge the support legs toward one another.

3. The isostatic press of claim 2, wherein said upper end of each leg includes an end surface having a circular contour wherein the center of curvature of the circular contour is displaced inward toward an inner surface of the frame from said mean force line of the leg.

4. The isostatic press of claim 1, wherein an upper end of each support leg includes along an inner face of the support leg an abutment for engagement with a corresponding abutment of a corresponding support leg when the support legs are deployed in a support position.

5. The isostatic press of claim 1, wherein means for pivoting said support legs between a position in which said legs carry said chamber closure and a position in which said chamber closure and said press tool are adapted to pass through said frame between said legs.

6. The isostatic press of claim 1, wherein first detection means are adapted to indicate when said upper ends of said support legs have attained a correct position relative to one another for supporting the chamber closure when it is received by the pressure chamber, said first detection means being adapted to inhibit pressurization of said pressure chamber in the absence of said detector indication.

7. The isostatic press of claim 6, wherein said first detection means are carried by said support legs.

8. The isostatic press of claim 7, wherein a second detection means positioned on said support legs are adapted to indicate pressure overload of the legs and interrupt pressurization of said chamber in response to said pressure overload.

9. The isostatic press of claim 2, wherein an upper end of each support leg includes along an inner face of the support leg an abutment for engagement with a corresponding abutment of a corresponding support leg when the support legs are deployed in a support position.

10. The isostatic press of claim 3, wherein an upper end of each support leg includes along an inner face of the support leg an abutment for engagement with a corresponding abutment of a corresponding support leg when the support legs are deployed in a support position.

11. The isostatic press of claim 2, wherein means for pivoting said support legs between a position in which said legs carry said chamber closure and a position in which said chamber closure and said press tool are adapted to pass through said frame between said legs.

12. The isostatic press of claim 3, wherein means for pivoting said support legs between a position in which said legs carry said chamber closure and a position in which said chamber closure and said press tool are adapted to pass through said frame between said legs.

13. The isostatic press of claim 4, wherein means for pivoting said support legs between a position in which said legs carry said chamber closure and a position in which said chamber closure and said press tool are adapted to pass through said frame between said legs.

14. The isostatic press of claim 2, wherein first detection means are adapted to indicate when said upper ends of said support legs have attained a correct position relative to one another for supporting the chamber closure when it is received by the pressure chamber, said first detection means being adapted to inhibit pressurization of said pressure chamber in the absence of said detector indication.

15. The isostatic press of claim 3, wherein first detection means are adapted to indicate when said upper ends of said support legs have attained a correct position relative to one another for supporting the chamber closure when it is received by the pressure chamber, said first detection means being adapted to inhibit pressurization of said pressure chamber in the absence of said detector indication.

16. The isostatic press of claim 4, wherein first detection means are adapted to indicate when said upper ends of said support legs have attained a correct position relative to one another for supporting the chamber closure when it is received by the pressure chamber, said first detection means being adapted to inhibit pressurization of said pressure chamber in the absence of said detector indication.

17. The isostatic press of claim 5, wherein first detection means are adapted to indicate when said upper ends of said support legs have attained a correct position relative to one another for supporting the chamber closure when it is received by the pressure chamber, said first detection means being adapted to inhibit pressurization of said pressure chamber in the absence of said detector indication.

18. The isostatic press of claim 2, wherein a second detection means positioned on said support legs are adapted to indicate pressure overload of the legs and interrupt pressurization of said chamber in response to said pressure overload.

19. The isostatic press of claim 3, wherein a second detection means positioned on said support legs are adapted to indicate pressure overload of the legs and interrupt pressurization of said chamber in response to said pressure overload.

20. The isostatic press of claim 4, wherein a second detection means positioned on said support legs are adapted to indicate pressure overload of the legs and interrupt pressurization of said chamber in response to said pressure overload.

* * * * *